US006649022B2

(12) United States Patent
Hammen et al.

(10) Patent No.: US 6,649,022 B2
(45) **Date of Patent: *Nov. 18, 2003**

(54) VENTILATED SEALING HEAD FOR INDUCTION SEALER

(75) Inventors: Richard R. Hammen, Menomonee Falls, WI (US); Ronald F. May, Lannon, WI (US)

(73) Assignee: Enercon Industries Corporation, Menomonee Falls, WI (US)

( * ) Notice: Subject to any disclaimer, the term of this patent is extended or adjusted under 35 U.S.C. 154(b) by 184 days.

This patent is subject to a terminal disclaimer.

(21) Appl. No.: 09/970,330

(22) Filed: Oct. 3, 2001

(65) Prior Publication Data

US 2003/0062130 A1 Apr. 3, 2003

(51) Int. Cl.[7] ..... H05B 6/42

(52) U.S. Cl. ..... 156/380.2; 53/477; 53/DIG. 2; 156/69; 219/632; 219/633; 219/661; 219/677

(58) Field of Search ..... 156/69, 379.6, 156/379.8, 380.2, 380.6, 498; 53/477, DIG. 2; 219/632, 633, 661, 677; 439/271, 374, 378, 380

(56) References Cited

U.S. PATENT DOCUMENTS

| | | | | |
|---|---|---|---|---|
| 4,095,390 | A | 6/1978 | Knudsen | 53/39 |
| 4,707,213 | A | 11/1987 | Mohr et al. | 156/380.2 |
| D398,314 | S | 9/1998 | Herzog | D15/146 |
| 6,158,864 | A | 12/2000 | Masuda et al. | 219/632 |
| 6,552,312 | B2 * | 4/2003 | Hammen et al. | 219/633 |

FOREIGN PATENT DOCUMENTS

| | | |
|---|---|---|
| EP | 0 818 791 A1 | 1/1998 |
| EP | 0 842 854 A2 | 5/1998 |

* cited by examiner

*Primary Examiner*—James Sells
(74) *Attorney, Agent, or Firm*—Quarles & Brady LLP

(57) ABSTRACT

An inductive cap sealer for sealing an inner seal over an opening in a container includes a vented sealing head. The sealing head contains an induction coil for producing an electromagnetic field when energized by a power supply. Field focusing elements contain the coil and direct the electromagnetic field to a sealing region beneath the sealing head. The housing has openings and the field focusing elements are spaced to allow cooling air to flow around the field focusing elements and past the coil.

9 Claims, 7 Drawing Sheets

FIG. 5
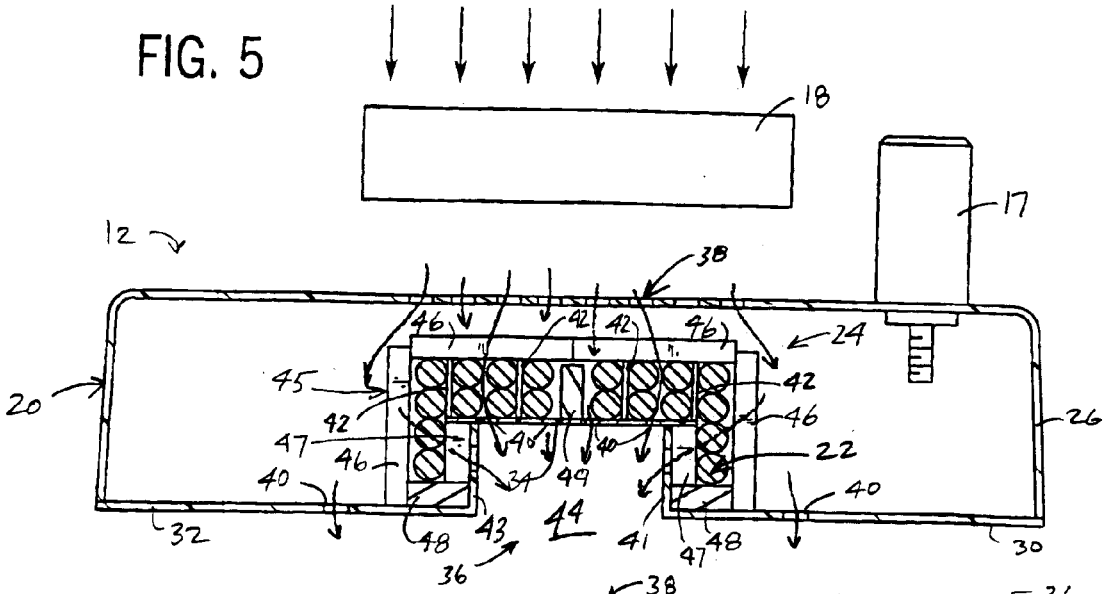
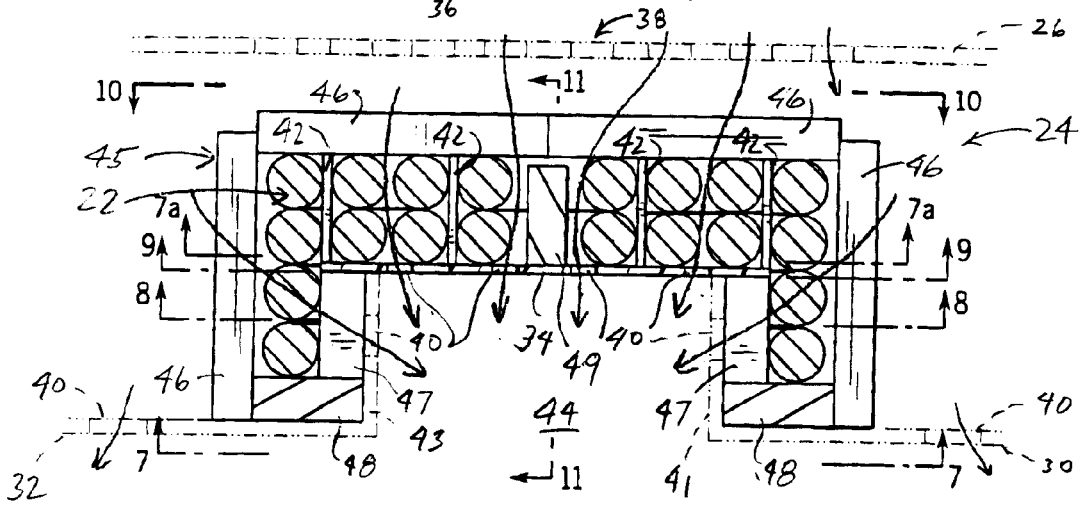
FIG. 6
FIG. 11
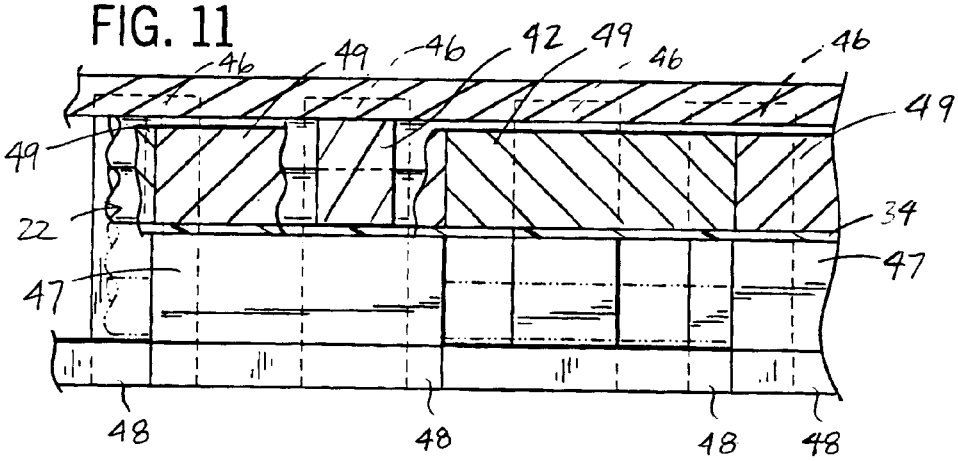

VENTILATED SEALING HEAD FOR INDUCTION SEALER

CROSS REFERENCE TO RELATED APPLICATIONS

Not applicable.

STATEMENT OF FEDERALLY SPONSORED RESEARCH/DEVELOPMENT

Not applicable.

BACKGROUND OF THE INVENTION

1. Field of the Invention

The invention relates to the field of heat sealing caps to containers. In particular, the invention relates to air cooled sealing heads.

2. Discussion of the Prior Art

It is known to seal the mouths of bottles and other containers using an inductive sealing process. Inductive sealing requires an electromagnetic-field-producing apparatus and a foil-polymer seal. Typically, the apparatus has at least one coil of wire wound to produce an electromagnetic field when electric current is supplied to the coil. It is well known in the art that electromagnetic fields induce eddy currents within metal which in turn heat the metal. The seal comprises a thin layer of aluminum foil onto which is laminated a polymer layer that is molecularly compatible with the container to be sealed. When the seal is placed onto the container and the container is placed within the electromagnetic field, the foil is heated which melts the layer of polymer. Removing the seal from the electromagnetic field allows the polymer to cool and molecularly fuse with the container to create an air-tight seal.

The electromagnetic field strength primarily depends upon the number of turns in the wire coils and the amount of current supplied to the coils. To produce an electromagnetic field adequate for commercial inductive sealing, typically the power supply must output power in the order of a few kilowatts, which produces a great deal of heat. Thus, the power supply must be cooled in order to function properly. Similarly, the sealing head having the induction coil must be cooled.

Many methods of cooling the power supply and sealing head are known in the art. In particular, it is known to circulate cool water through the power supply enclosure and the sealing head. Such water cooled cap sealers, however, require complicated piping configurations that increase size and cost. It is also known to vent the power supply and force air past the outside of the sealing head. However, such air cooled cap sealers sometimes provide inadequate cooling of the sealing head which degrades the operating efficiency of the cap sealer.

SUMMARY OF THE INVENTION

The invention provides a ventilated sealing head for an inductive cap sealer. Specifically, the sealing head includes an induction coil for producing an electromagnetic field. One or more field focusing elements are disposed adjacent the coil to direct the electromagnetic field of the coil toward a sealing region beneath the sealing head. The coil and the field focusing elements are contained in a housing having openings allowing air to flow past the coil.

In a preferred form, the field focusing elements are a ferromagnetic compound and there are a plurality of field focusing elements spaced apart along at least a portion of the periphery of the coil allowing air to flow between the spaced field focusing elements and past the coil.

In other forms, the housing forms a tunnel extending lengthwise from side to side of the sealing head and opening downward at the sealing region. The coil is wound around the tunnel and within a number of electromagnetic field focusing elements. The sealing head further includes a pair of plug-in shielded connectors for coupling the coil to power.

Another aspect of the invention is a cap sealer having an AC power supply and an external vented sealing head as described above. The cap sealer can further include an external fan disposed between the sealing head and the power supply for forcing cooling air through the sealing head.

The invention thus provides a vented sealing head for an inductive cap sealer. Venting the sealing head allows cooling air to be blown passed the coil and field focusing elements to carry away heat from these components and convectively cool the sealing head. The sealing head can thus be cooled without a separate cooling circuit and without the costly and difficult to assemble tubing arrangements associated with liquid cooling.

The foregoing and other advantages of the invention will appear from the following description. In that description reference is made to the accompanying drawings, which form a part hereof, and in which there is shown by way of illustration a preferred embodiment of the invention. This embodiment does not represent the full scope of the invention. Thus, the claims should be looked to in order to judge the full scope of the invention.

BRIEF DESCRIPTION OF THE DRAWINGS

FIG. 5 is a cross-sectional view taken along line 5—5 of FIG. 3 at an opening between the spaced field focusing elements;

FIG. 6 is a partial enlarged view of FIG. 5 with the housing shown in phantom;

FIG. 11 is a side cross-sectional view taken along line 11—11 of FIG. 6 and in partial cut-away to show a coil spacing element.

DETAILED DESCRIPTION OF THE PREFERRED EMBODIMENT

Figure 12:
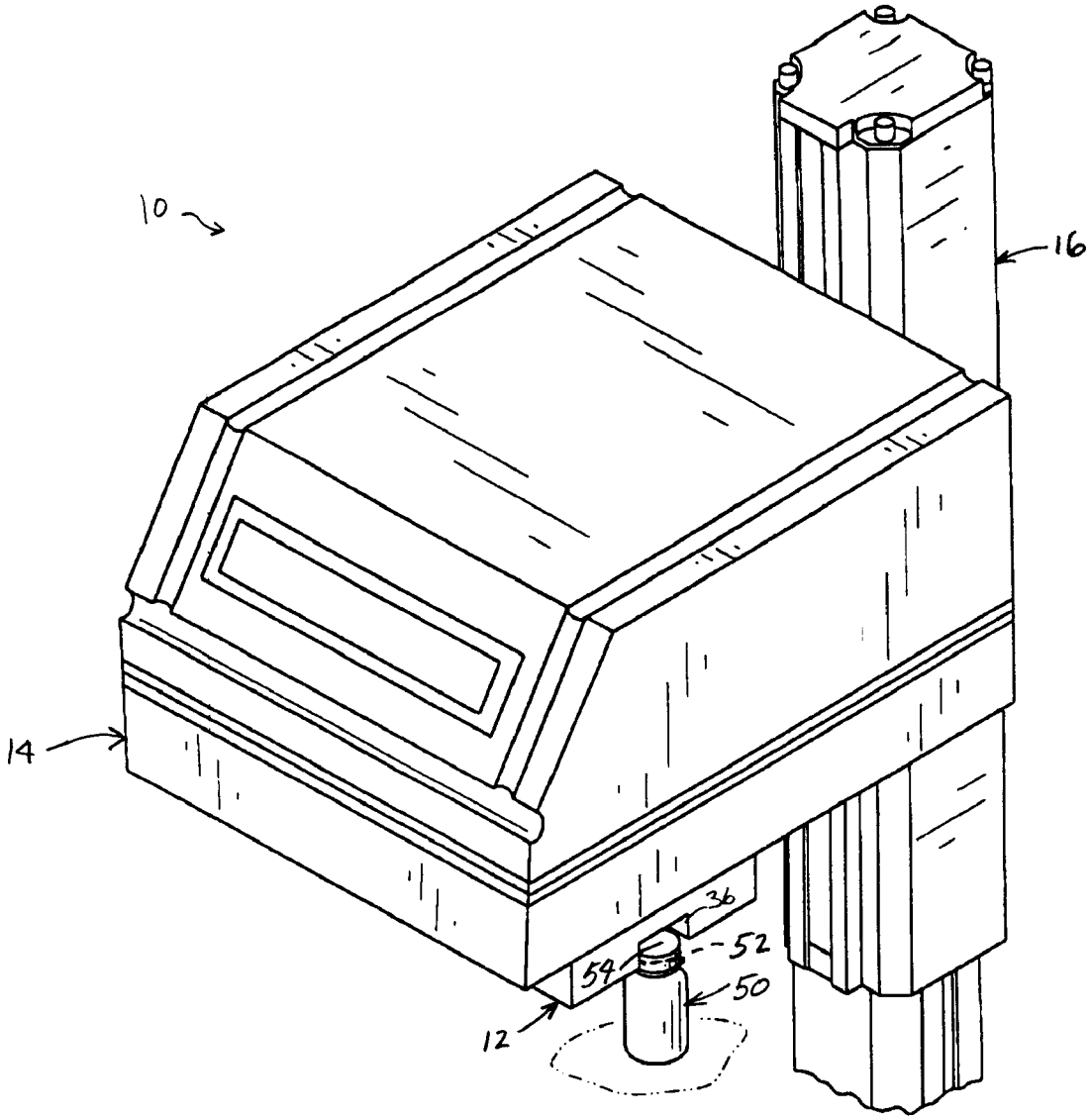
FIG. 12 is a front perspective view of an induction air cooled cap sealer having a vented sealing head.

An air cooled cap sealer 10 is shown in FIG. 12. The cap sealer 10 is preferably of the type described in U.S. Pat. No. 6,153,864 assigned to the assignee of this application and hereby incorporated by reference as through fully set forth herein. Generally, the cap sealer 10 has a sealing head 12 powered by and mounted to a power supply cabinet 14 supported on an adjustable mounting assembly 16. The sealing head 12 is electrically connected to the power supply cabinet 14 via a pair of bus wires (not shown) coupled to shielded, plug-in type socket connectors mateable with connectors 17 (see FIG. 1) on the sealing head 12. Preferably, two cooling fans 18 (one shown in FIGS. 4 and 5) are mounted between the sealing head 12 and the power supply cabinet 14, one cooling the sealing head 12 and the other the power supply cabinet 14. The sealing head 12 is vented to improve cooling by allowing cooling air to pass through the sealing head 12.

Figure 1:
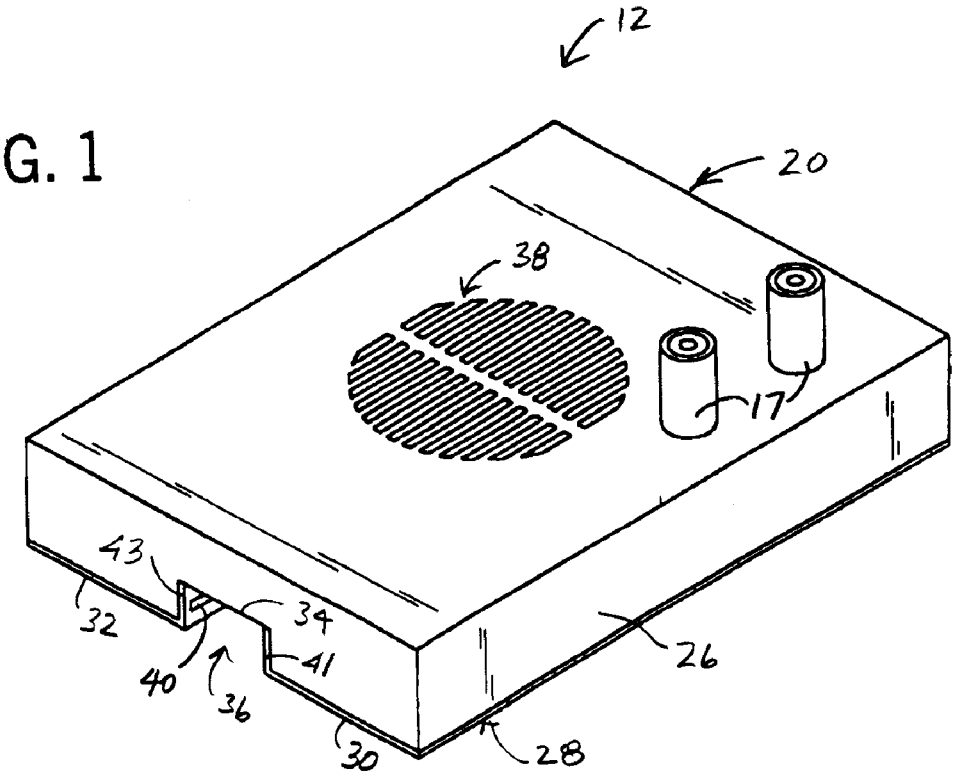
FIG. 1 is top perspective view of a ventilated sealing head according to the present invention.
Figure 2:
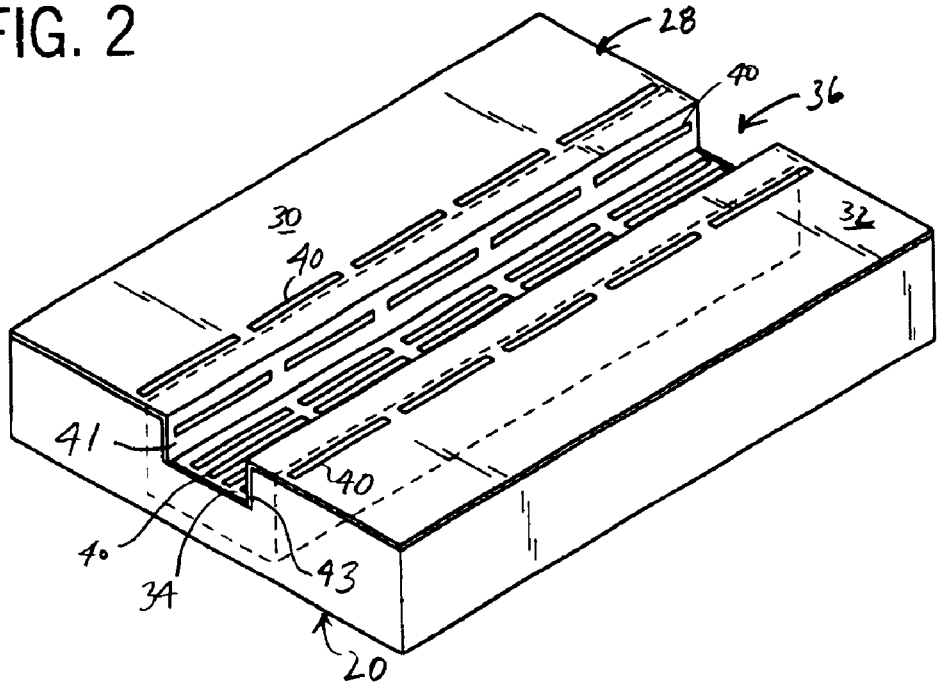
FIG. 2 is a bottom perspective view of the ventilated sealing head.
Figure 3:
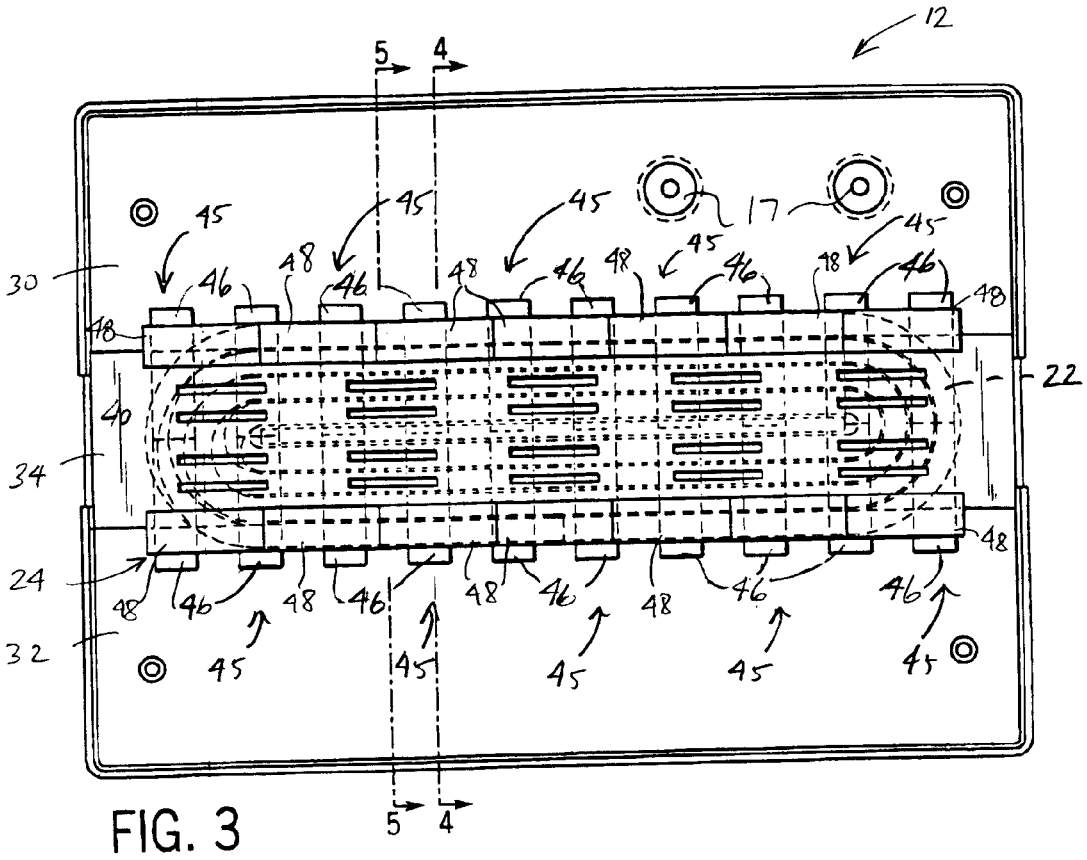
FIG. 3 is a bottom plan view of the ventilated sealing head with the bottom cover removed to show the wire coil and field focusing assembly.

Referring to FIGS. 1, 2 and 3, the sealing head 12 has a housing 20 containing an electromagnetic coil 22 wound about a field focusing coil housing 24 formed by one or more electromagnetic field focusing elements joined together by a suitable epoxy resin. The housing 20 is preferably made of an ABS plastic material and comprises an inverted tray 26 and a bottom cover 28. The tray 26 has a rectangular top with downwardly extending walls along its periphery. The bottom cover has front 30, back 32 and center 34 panels defining a recessed tunnel 36 extending from side to side across the width of the bottom of the sealing head 12. The top of the inverted tray 26 has a generally circular grille 38 with a plurality of openings allowing air into the housing 20. The front 30 and back 32 panels of the bottom cover 28 each has two rows of lateral slots 40, respectively. One of the rows of each panel is located in short legs 41 and 43 forming the sides of the tunnel 36. The center panel 34 has four rows of five slots 40 aligned in parallel. The bottom cover 28 is fastened to the tray 26 by a suitable adhesive applied to their edges or as disclosed in the '864 patent. When assembled, air can pass into the top of the sealing head 12 through openings in the grille 38 and exit through the slots 40 in the bottom of the sealing head 12.

Figure 4:
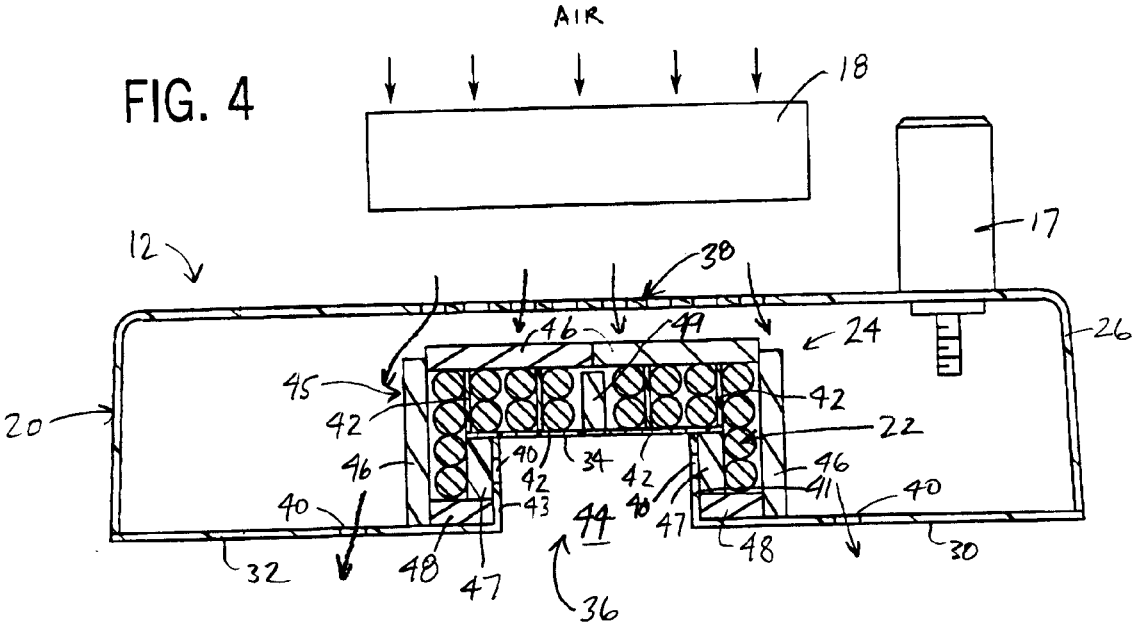
FIG. 4 is a cross-sectional view taken along line 4—4 of FIG. 3 with a set of field focusing elements shown in cross-section.
Figure 7:
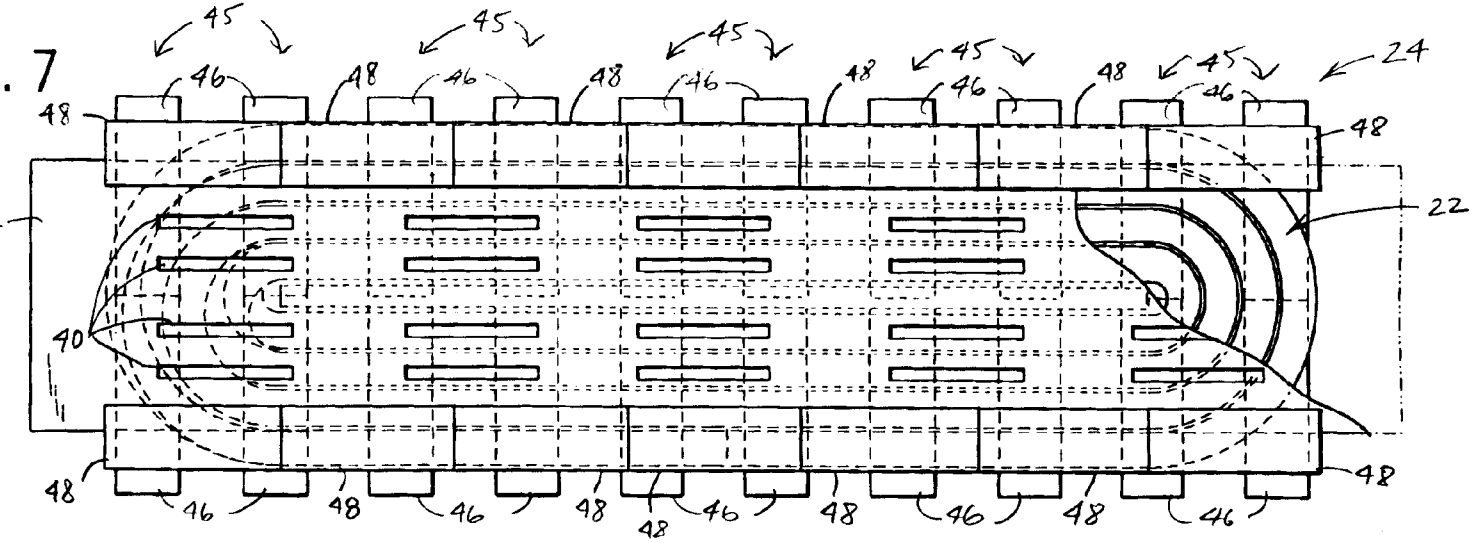
FIG. 7 is a bottom view taken along lien 7—7 of FIG. 6 showing the field focusing assembly with the electromagnetic coil wound therein and with a center panel of the housing shown cut-away to reveal the coil.
Figure 8:
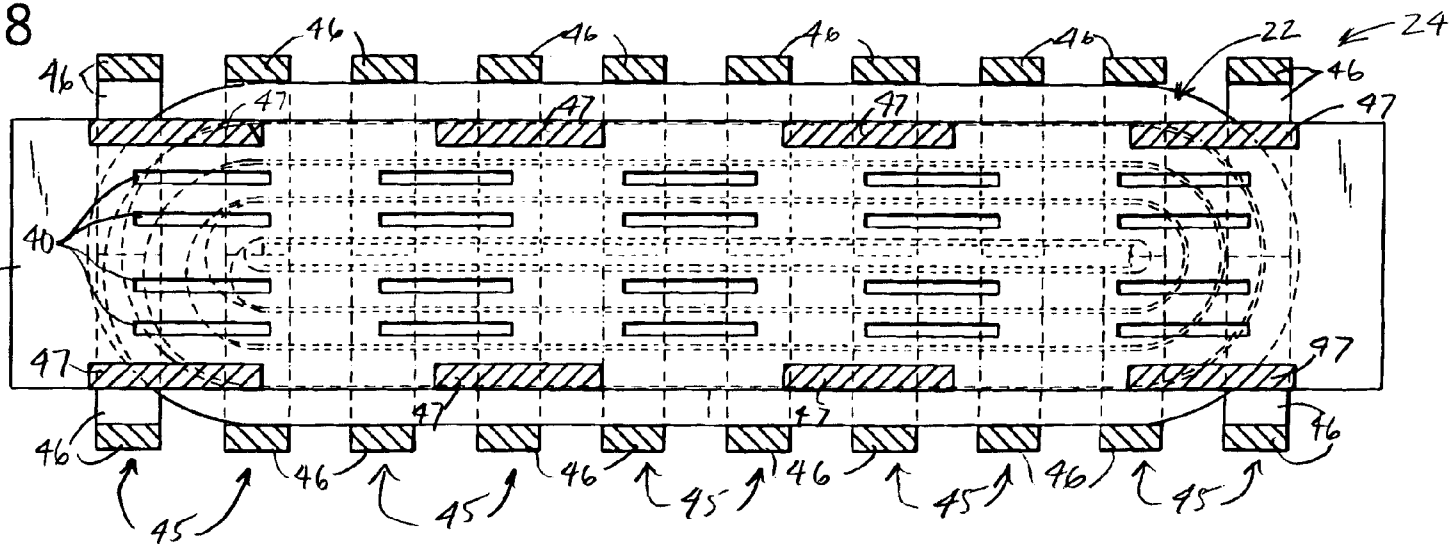
FIG. 8 is a cross-sectional view similar to FIG. 7 albeit taken along line 8—8 of FIG. 6.
Figure 7A:
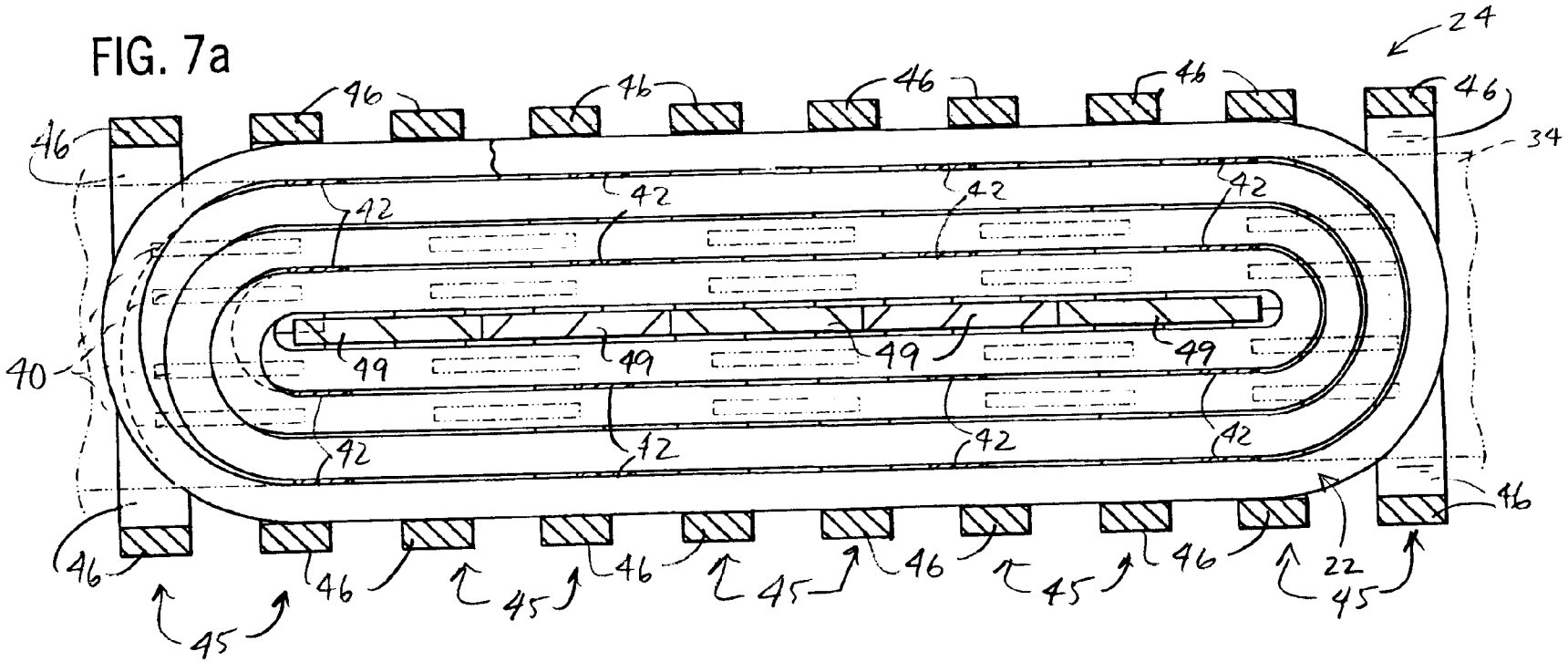
FIG. 7*a* is a cross-sectional view similar to FIG. 7 albeit taken along line 7*a*—7*a* of FIG. 6.
Figure 9:
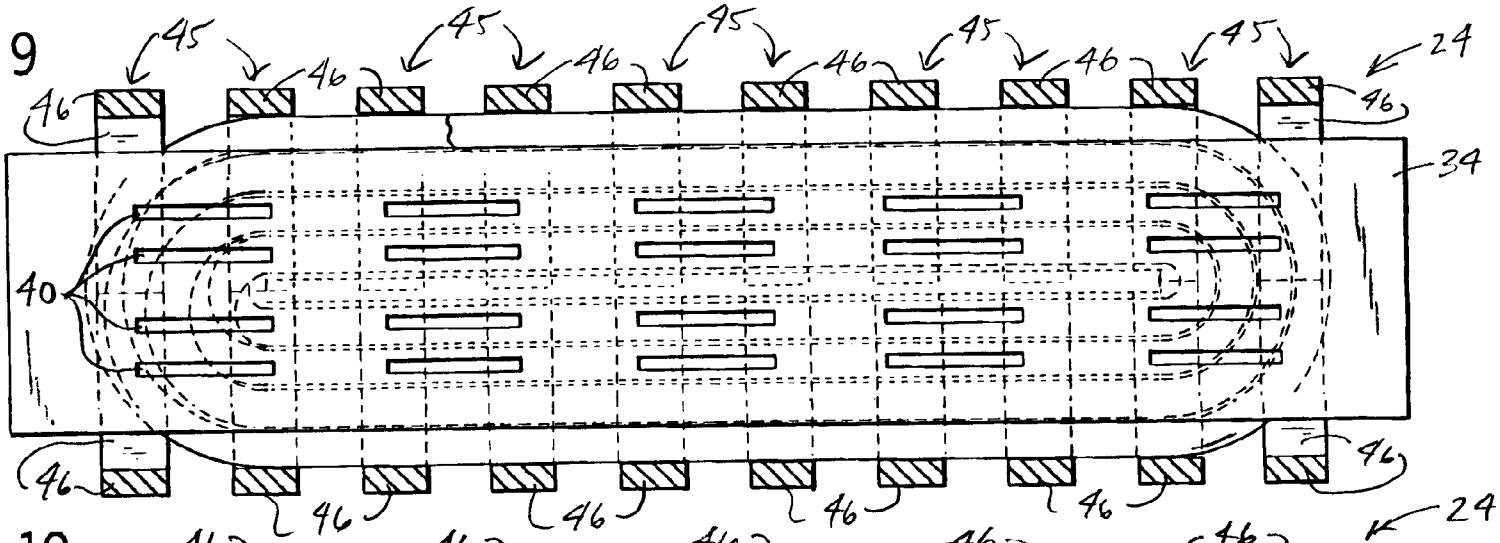
FIG. 9 is a cross-sectional view similar to FIG. 7 albeit taken along line 9—9 of FIG. 6.
Figure 10:
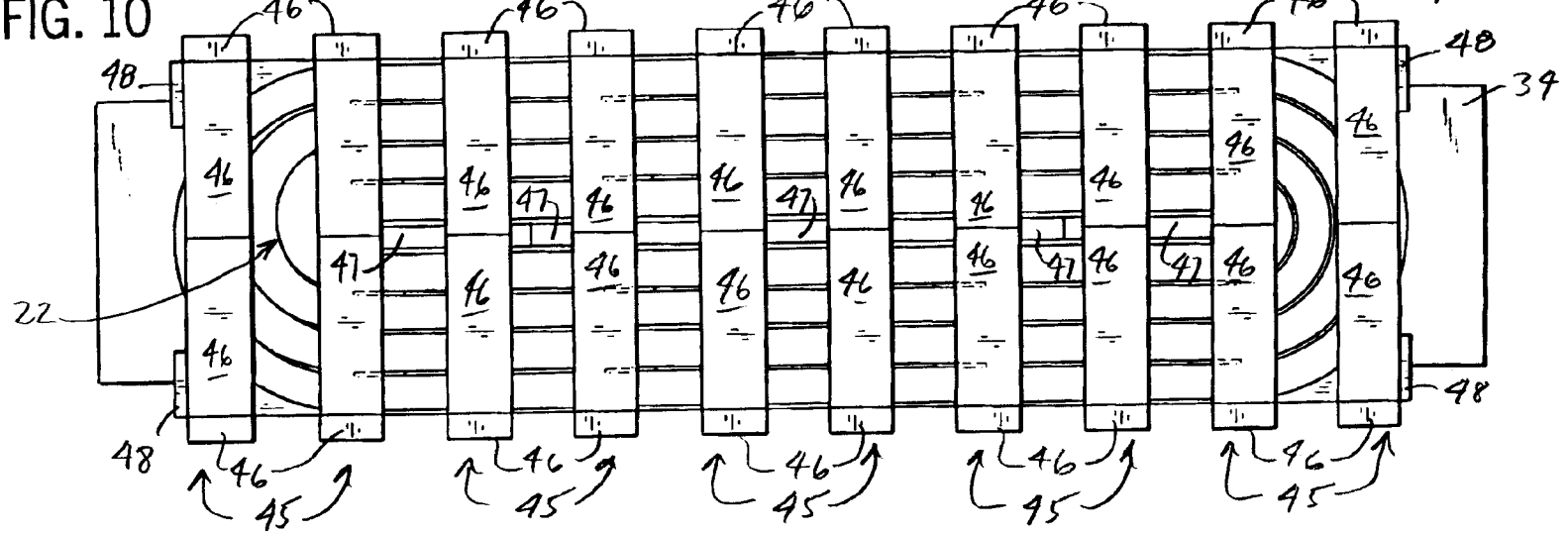
FIG. 10 is a top view of the field focusing assembly and coil taken along line 10—10 of FIG. 6.

Referring to FIGS. 4–6, the coil housing 24 and coil 22 are disposed around the tunnel 36 to surround it along its length from the top and sides. The coil 22 is formed of bundled wire, such as Litz wire, known to those skilled in the art. The number of windings and the gauge of the wire are selected according to the sealing requirements of the application, as known in the art. The coil 22 is wound within the coil housing 24 around the tunnel 36 and windings are spaced apart by four sets of four spacers 42 adhered to the center panel 34 of the bottom cover 28 and extending upwardly into the housing 20 (see FIGS. 6, 7*a* and 11).

Referring still to FIGS. 4–6 as well as FIGS. 7–11, the coil housing 24 is comprised of a number of rectangular blocks made of a ferromagnetic compound having ferric oxide, so that, rather than radiating omni-directionally, the electromagnetic field produced by the coil 22 is directed downward to a sealing region 44 within and/or below the tunnel 36. In the embodiment shown in the figures, the blocks are arranged in ten inverted U-shaped segments 45 having four blocks 46 each, two aligned end to end in the front-back direction of the sealing head 12 and two bookends extending vertically. Each segment 45 is spaced apart in the side to side direction of the sealing head 12, approximately the width of a block. Two rows of four blocks 47 are disposed on each side of the tunnel 36 spaced laterally between the coil 22 in the side to side direction. Two rows of seven blocks 48 are disposed end to end with their bottom faces against the front 30 and back 32 panels of the bottom cover 28 on each side of the tunnel 36 beneath the two rows of four blocks 47. These seven blocks 48 are not spaced in the side to side direction so as to provide a rigid corner along much of the tunnel 36. Finally, a row of five blocks 49 are disposed end to end on their side edges along the center of the center panel 34 extending in the side to side direction of the sealing head 12 between the coil 22.

The arrangement of the field focusing blocks forming the coil housing 24 has been empirically shown to direct the electromagnetic field toward the sealing region 44 while allowing air entering the housing 20 to pass by the blocks. Air is blown by the fans above the sealing head 12 into the grille openings in the top of the tray 26 and some air will exit the sealing head housing 20 through the centermost slots 40 in the bottom cover 28. A portion of the air flow, however, is interrupted by the blocks and/or the coil 22 such that it will circulate through the sealing head 12 from front to back and side to side allowing most, if not all, of the coil 22 and coil housing 24 to be cooled convectively. Moreover, warmer portions of the coil 22 will pass heat to cooler portions of the coil 22 so that the coil 22 will be conductively cooled as well.

The invention thus provides a vented sealing head for an inductive cap sealer and a cap sealer having such a sealing head. Venting the sealing heat allows cooling air to be blown passed the coil and field focusing elements to carry away heat from these components and convectively cool the sealing head. The sealing head can thus be cooled without a separate cooling circuit and without the costly and difficult to assemble tubing arrangements associated with liquid cooling.

With reference to FIGS. 3 and 12, the cap sealer 10 is operated by first adjusting it vertically if needed according to the height of a container 50 to be sealed. The mouth of the container 50 is then covered with an inner seal 52 having a polymer layer laminated to an aluminum foil layer. A cap 54 is snapped, screwed or otherwise fit onto the mouth of the container 50, which places a downward force on the inner seal 52. The container 50 is then placed upright with the cap 54 under the sealing head 12 in the sealing region 46. Applying power to the coil 22 produces an electromagnetic field directed downwardly from the sealing head 12 to the sealing region 46 for a prescribed period of time which heats the foil layer and melts the polymer layer. The container 50 is removed from beneath the sealing head 12 which allows the polymer layer to cool and fuse to the mouth of the container 50. The cap sealer 10 may be operated manually, placing one container 50 at a time beneath the sealing head 12, or it may be used to seal a number of containers 50 continuously or intermittently passing through the electromagnetic field under the sealing head 12 on a conveyor belt or similar assembly line.

Illustrative embodiments of the invention have been described in considerable detail for the purpose of disclosing practical, operative structures whereby the invention may be practiced advantageously. The designs described are intended to be illustrative only. The novel characteristics of the invention may be incorporated in other structural forms without departing from the scope of the invention. For example, the sealing head can be interchangeably mounted to the power supply cabinet so that sealing heads of other configurations may be used for various sealing applications, such as a vented flat sealing head particularly suitable for wide necked containers. Moreover, the sealing head may have more than one induction coil mounted in various orientations and the coil housing could be monolithic with openings made therein for air to flow through the coil housing and past the coil.

It can thus be appreciated that many variations are possible from the preferred embodiment described above without departing from the spirit of the invention. Reference should therefore be made to the claims for interpreting the entire scope of the invention.

What is claimed is:

1. A ventilated sealing head for an inductive cap sealing apparatus, comprising:

an induction coil for producing an electromagnetic field;

one or more field focusing elements disposed to at least partially surround the coil and direct the electromagnetic field of the coil toward a sealing region beneath the sealing head; and a housing containing the coil and the field focusing elements and having openings allowing air to flow past the coil.

2. The sealing head of claim 1, wherein there are a plurality of field elements spaced apart along at least a portion of the periphery of the coil focusing allowing air to flow between the spaced field focusing elements.

3. The sealing head of claim 1, wherein the field focusing elements are a ferromagnetic compound.

4. The sealing head of claim 1, wherein the housing forms a lengthwise tunnel opening downward at the sealing region.

5. The sealing head of claim 4, wherein the coil and the field focusing elements are disposed within the housing around the tunnel.

6. The sealing head of claim 1, wherein the coil is bundled wire.

7. The sealing head of claim 1, further including a pair of shielded connectors for coupling the coil to power.

8. An apparatus for inductively sealing an inner seal over an opening in a container, comprising:

a power supply for producing alternating current;

an external sealing head mounted to the power supply having a housing containing an induction coil for producing an electromagnetic field when energized by the power supply and field focusing elements arranged to at least in part surround the coil and direct the electromagnetic field to a sealing region beneath the sealing head, wherein the housing has openings allowing air to flow past the coil.

9. The apparatus of claim 8, further including an external fan disposed between the sealing head and the power supply so as to force air into the openings in the housing.

* * * * *

UNITED STATES PATENT AND TRADEMARK OFFICE

CERTIFICATE OF CORRECTION

PATENT NO. : 6,649,022 B2
DATED : November 18, 2003
INVENTOR(S) : Richard R. Hammen et al.

It is certified that error appears in the above-identified patent and that said Letters Patent is hereby corrected as shown below:

Column 5,
Line 27, after "field" insert -- focusing --; and
Line 28, after "coil" delete "focusing".

Signed and Sealed this

Fifteenth Day of June, 2004

JON W. DUDAS
*Acting Director of the United States Patent and Trademark Office*